US005813539A

United States Patent [19]

DePalma

[11] Patent Number: 5,813,539

[45] Date of Patent: Sep. 29, 1998

[54] CALENDAR ORGANIZER

[76] Inventor: Donald Francis DePalma, 1400 El Camino Village Dr., Apt.#211, Houston, Tex. 77058

[21] Appl. No.: 920,302

[22] Filed: Aug. 28, 1997

[51] Int. Cl.[6] ..... G09D 3/04

[52] U.S. Cl. ..... 206/459.1; 206/459.5; 40/107; 40/110; 383/39

[58] Field of Search ..... 206/459.1, 232, 206/425, 459.5, 775, 484, 534, 806; 40/5, 299, 360, 107, 110; 383/38, 39

[56] References Cited

U.S. PATENT DOCUMENTS

| | | | |
|---|---|---|---|
| 384,526 | 6/1888 | Isbell | 40/107 |
| 770,354 | 9/1904 | Corfman | 383/39 |
| 811,846 | 2/1906 | Hidden | 40/107 |
| 962,595 | 6/1910 | Smith | 383/39 |
| 3,207,421 | 9/1965 | Hunger et al. | 383/39 |
| 4,241,526 | 12/1980 | Poritz | 40/107 |
| 5,018,287 | 5/1991 | Fast | 206/459.5 |
| 5,257,940 | 11/1993 | Schaarschmidt | 40/107 |

*Primary Examiner*—Paul T. Sewell
*Assistant Examiner*—Luan K. Bui
*Attorney, Agent, or Firm*—Michael B. Jolly

[57] ABSTRACT

A calendar organizer for displaying one month comprising six rows of seven pouches, the pouches representing days of the month while the rows represent weeks. The pouches are dimensioned to easily receive a number of standard mailing envelopes. Mail, messages, or reminders are inserted into the pouch representing the relevant date. A means is provided for changing the pouch numbering to match the present month. The pouches are attached on backing material allowing the calendar to be displayed, such as hanging from the top edge of a door or a wall. Accessory pouches are also provided which store reminders identifying important events, holidays, vacations, bill payment docketing, etc.

4 Claims, 2 Drawing Sheets

CALENDAR ORGANIZER

BACKGROUND OF THE INVENTION

The present invention is a useful household monthly calendar used to schedule daily events and which the entire month is quickly referenced at a glance. Numerous devices have been developed which function as both a calendar and organizer, ranging from desk top date planners to wall mounted calendars. Although these devices are useful, there is no device which stores reminders in a daily pouch and displays an entire month of pouches with the messages to facilitate household event planning, such as timely bill payment and other monthly events. This invention comprises six rows of seven pouches or pockets attached to backing material. The six rows represent weeks in a month while the seven pouches represent days of the week. The pouches are used to receive mail, messages, reminders or other items relevant to the given day represented by the pouch. Pouch numbering means are also provided for properly dating the pouches for a given month. Pouch labeling means are also provided for highlighting pouches which represent significant dates to remember. Both of the pouch numbering and labeling means are moveable allowing the days of a the month to be correctly numbered and changed as the month changes, and labels moved to the appropriate day for the event to be remembered. The days of the week are labeled and affixed to the calendar top area while a changeable month label is provided for labeling the organizer for a specific month. Backing material provides a support for the pouches and a means for displaying the organizer, most preferably by hanging the organizer from an interior household door or wall. The backing material may also include decorative borders or patterns. The pouches are about four and one half inches wide, which width will receive a standard size 10 business envelope when the envelope is standing on edge, while the entire organizer is dimensioned to be hung on a standard door 32 inches in width so that the entire month of pouches, messages and envelopes are easily viewed at a glance. A bottom row of pouches are provided to store pouch labeling means, numbering means, month labeling means and other items.

SUMMARY OF THE INVENTION

It is accordingly an objective of the present invention to provide a calendar and household organizer which displays a present month, the organizer comprising six rows of seven pouches providing a multiplicity of pouches which are numbered appropriately for a present month where each calendar day of the month is represented by a pouch. Each pouch width is dimensioned to easily receive a multiplicity of standard mailing envelopes, the pouches further providing a means to receive messages, reminders and other information relevant to a given day. Furthermore, a means is provided for changing the numbering of the pouches to represent the present calendar month and changing the month label to name the present month. The pouches are further mounted to backing material which provides a means for displaying the organizer and further providing a means for mounting the organizer to a wall or a door. Accessory pouches are also provided which store pouch labeling means, which means include message tabs which identify important events such as holidays, vacations, bill payment docketing, notices, etc.

DETAILED DESCRIPTION OF THE DRAWINGS

Figure 1:
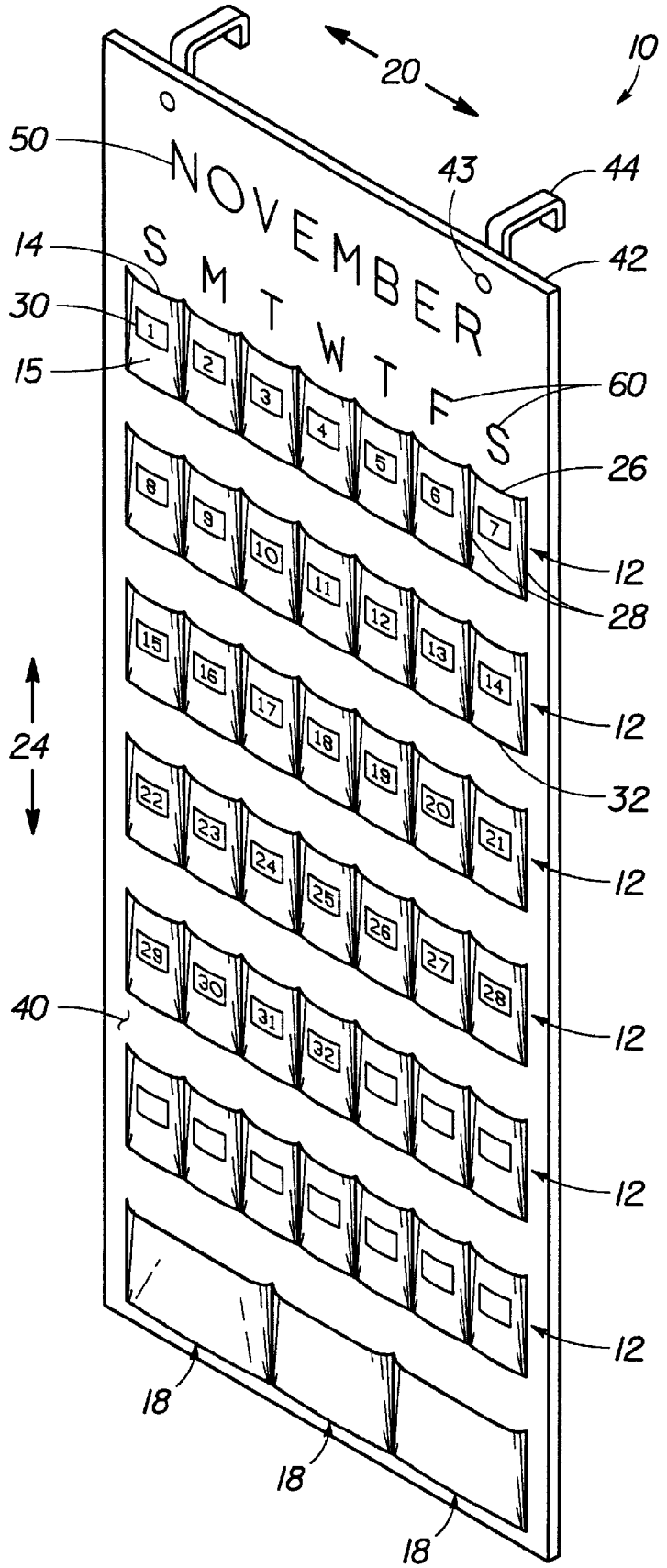
FIG. 1 Is a perspective view of the calendar organizer.
Figure 2:
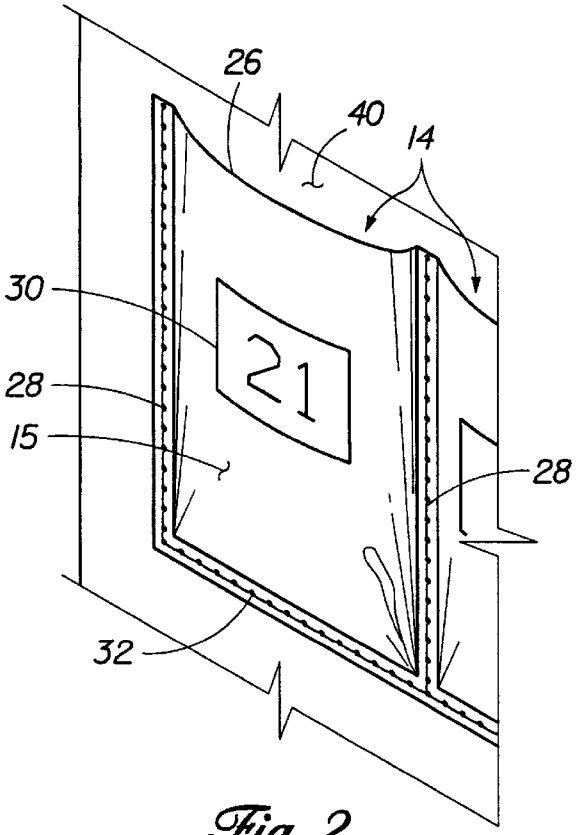
FIG. 2 Is a perspective view of an individual calendar pouch illustrating the attachment means of the pouch to the backing and a pouch numbering means, FIG. 3A Is a side view of clip type pouch numbering means, FIG. 3B Is a side view of a velcro type pouch numbering means, and FIG. 3C Is a side view of a snap type pouch numbering means.

Referring to the drawings, FIG. 1 illustrates the calendar organizer 10 with six rows 12 of seven pouches 14 in each row. Three accessory pouches 18 are provided at the bottom of the calendar. There may be more or less accessory pouches without affecting the functionality of the invention. The pouches 14 are labeled or marked with a pouch numbering means 30 that is attached to the outer surface 15 of the individual pouches. The pouches 14 and the accessory pouches 18 are attached to a backing 40 material by use of sewing, adhesives, or other attachment means which permanently attaches the pouches to the backing material. The pouches and pouch numbering means may also be releasably attached to the backing material and may be detachable as a complete row of pouches and pouch numbering means or a complete column of pouches and pouch numbering means. The backing 40 is rectangular and about thirty one to about thirty three inches wide or wider and at least seventy three inches long. This dimension for the backing 40 allows the calendar to be placed on a standard thirty two inch door, or wider door, while also allowing for the pouches 14 to be about four and one half inches wide while the pouch bottom edge 32 of the pouches in a given row are about nine to about ten inches from the bottom edge 32 of the pouches in the next row.

The top edge of the backing 40 material provides space for labeling the days of the week with permanently affixed labels 60 or labels preprinted onto the backing material. The month is labeled by a removable, or erasable month labeling means 50. The month labeling means 50 is preferable at the top edge of the backing material 40 while the material for the month label depends upon the type of label desired. The month label may be composed of plastic, wood, metal, paper, cloth material or the like and may be permanently affixed or easily detached by the use of adhesives, sewing, pins, snaps, buttons, or hooks and may or may not be an erasable marker surface.

The backing 40 is constructed most preferable of decorative durable cloth or manmade decorative fabric which will support the weight of the pouches 14 and their contents. The backing top edge 42 has positioned a multiplicity of calendar hanging means 44. FIG. 1 illustrates two hooks 44 attached to the base top edge 42 through eyelets 43. The hooks 44 allow the calendar to be attached to a door by placing the hooks over the top edge of a door. Other methods are contemplated for attaching the calendar to a door or wall such as a multiplicity of nails or tacks, a dowel, hanging wire or cable or other known attachment means.

Figure 4:
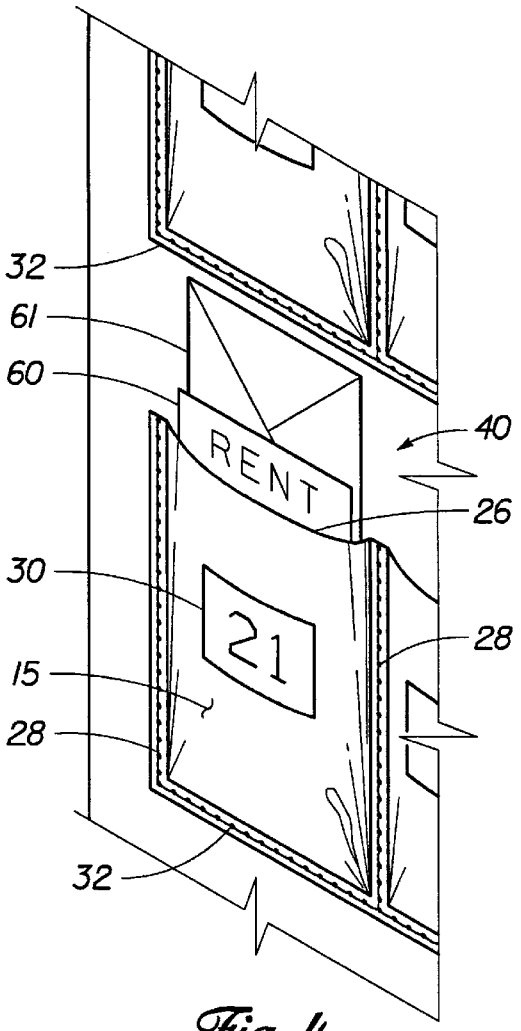
FIG. 4 Is a perspective view of an individual pouch illustrating a reminder placed therein.

The pouches 14 each have an open top edge 26 and side edges 28 secured to the backing material 40. The pouch bottom edge 32 is also secured to the backing material 40 and the pouch outer surface 15 faces a viewer of the organizer. The pouch side and bottom edges are attached, most preferable, by sewing the pouches to the backing material, other method may be employed such as the use of adhesives, velcro, rivets, or the like. The preferred material for both the backing material and pouches is a flexible decorative durable cloth material which material provides for ease of manufacturing the organizer and a preferable flexible organizer, the material used to construct the backing may also be rigid, such as wood, plastic, composites, or other suitable material. The pouches 14 are substantially rectangular or square in shape and about four and one half inches wide and about four to about five inches tall. The preferred pouch width will allow the pouch to receive a standard size ten business envelope, while the height of the pouch will allow a portion of an envelope, which is inserted into the pouch, to project above the top edge 26 of the pouch and therefore be viewed by the organizer observer. The bottom edge 32 of the pouches in a given row 12 is most preferable about nine to about ten inches from the bottom edge 32 of the next row of pouches, this distance between pouch rows allows an envelope 61 to be inserted into a pouch 14 and viewed without the envelope 61 blocking the view of the pouch numbering 30 or labeling 60 means immediately above the pouch containing the envelope, as illustrated in FIG. 4. The pouch edges 28 may either be gathered for expanding the pouches or substantially flat, preferably the pouches have gathered excess material allowing the pouch to be expanded outwardly from the backing material increasing the pouches volume which allows numerous envelopes to be inserted into one pouch.

Figure 3A:
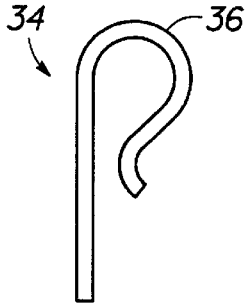
Figure 3B:
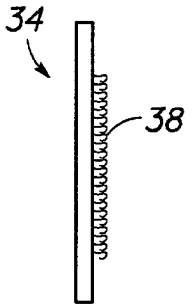
Figure 3C:
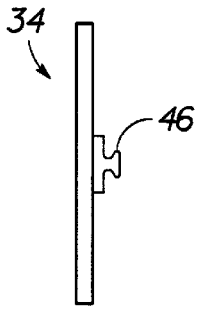

A pouch numbering means 30 is illustrated in the figures and is primarily used to number pouches to correspond to the days of a given month. The numbering means may be a fixedly secured erasable marker surface permanently affixed to the face of each pouch providing an erasable writing surface. The numbering means may also be thirty one separate removable numbering means consecutively numbered from one to thirty one. FIGS. 3A–C illustrate three alternative means for attaching the numbering means to the pouch outer surface 15. FIG. 3A illustrates a clipping means 36, FIG. 3B a velcro means 38, and FIG. 3C a snapping means 46. Other attaching means are contemplated including adhesive, hooks, safety pins, and buttons. The numbering means have a readable surface 34 which is visible to the observer of the organizer once the numbering means are installed upon a pouch. The numbering means may be constructed of durable decorative material, and depends upon the numbering means attachment means employed. For example, cloth material may be used for the velcro, snap, safety pin, button, and hook means, while plastic, metal, paper, or wood may be used for the erasable writing surface utilizing a clipping means in addition to the other attachment means. The readable surface may have numbers permanently printed upon it or the readable surface may be an erasable marker surface.

A pouch labeling means 60 is also provided and stored in accessory pouches. The pouch labeling means is separate from the pouch numbering means 30 and functions as a reminder tab to be placed in or on a specific date to be remembered, as illustrated in FIG. 4. The means for attaching the labeling means to a pouch, and the materials used to construct the labeling means can be similar to the numbering means, as illustrated in FIGS. 3A–C. The labeling means 60 may also be a pouch insert, which is slipped into a specific pouch, the insert having a length which extends over the top open edge of the pouch and allows the message on the insert to be viewed, as in FIG. 4. The labeling means may include numerous pre-printed labels such as "Birthday", "Anniversary", "Graduation", "bill payment", etc. which are attached to the appropriately dated pouch outer surface 15 or inserted into the pouch, so the date can be readily referenced at a glance. The accessory pouches 18 are located near the bottom edge of the backing material. The accessory pouch dimensions are not critical to the function of the organizer but are most preferable larger than the day pouches to provide storage spaces for mail, labeling means, and excess numbering means. The inventor contemplated placing a multiplicity of accessory pouches near the bottom of the organizer.

I claim:

1. A calendar organizer, comprising:

a) six rows of seven pouches mounted to backing material, each pouch being about four and one half inches wide and about four to about five inches tall, the seven pouches in each row represents days of a week while the six rows represent weeks of a month, the pouches having a top edge unsecured to the backing material and sides and bottom edges secured to the backing material, the bottom edge of each row of pouches being about nine to about ten inches from the bottom edge of the row of the next row of pouches, the pouches further having an outer surface, b) selective pouch numbering means, providing a means for numbering the pouches to coincide with a month of interest, the numbering means further allowing the numbering of the pouches to be changed as the month of interest changes, c) selective pouch labeling means providing a means for labeling specific days of the month with a reminder, d) said backing material having top, bottom and side edges, the top edge providing a means for hanging the organizer for display, said hanging means comprising a multiplicity of hanging means securely attached to the backing material top edge, said hanging means providing a means for hanging and displaying the organizer, and e) a multiplicity of accessory pouches attached on the backing material and positioned near the backing material bottom edge, said accessory pouches providing a means for storing unused pouch numbering means, labeling means and other items.

2. The calendar organizer as set forth in claim 1 wherein said selective pouch numbering means further comprises 31 numbering means consecutively numbered from 1 to 31 and an attachment means providing a means for removable attachment of the numbering means to the outer surface of the pouches.

3. The calendar organizer as set forth in claim 2 wherein said attachment means is selected from a group consisting of: velcro, snap, adhesive, clip, hook, safety pin, and button.

4. The calendar organizer as set forth in claim 1 wherein said selective pouch numbering means further comprises a marker erasable surface attached to the outer surface of the pouches.

* * * * *